United States Patent [19]

Coast

[11] 4,183,515

[45] Jan. 15, 1980

[54] BAG FOLDING MACHINE

[75] Inventor: John B. Coast, Baton Rouge, La.

[73] Assignee: Union Carbide Corporation, New York, N.Y.

[21] Appl. No.: 920,130

[22] Filed: Jun. 28, 1978

[51] Int. Cl.[2] ..... B65H 45/18

[52] U.S. Cl. ..... 270/83; 93/84 R

[58] Field of Search ..... 270/69, 67, 83, 62; 242/55, 67.1, DIG. 3; 53/118, 120; 93/84 R

[56] References Cited

U.S. PATENT DOCUMENTS

| | | | |
|---|---|---|---|
| 3,671,033 | 6/1972 | Coast | 270/83 |
| 3,918,698 | 11/1975 | Coast | 270/69 |

*Primary Examiner*—Clifford D. Crowder

*Assistant Examiner*—A. Heinz

*Attorney, Agent, or Firm*—Eugene Lieberstein

[57] ABSTRACT

In a bag folding machine of the type which includes a rolling section for winding the bag into a roll, with the rolling section divided into two sub-sections spaced a predetermined distance apart to form an open area therebetween including means for withdrawing the bag from the rolling section the improvement comprising said bag withdrawal means being arranged to withdraw the bag through the open area in a predetermined discharge direction with each sub-section having an entrance opening with a substantially flat surface on opposite sides of the open area in a common plane transverse to the discharge direction.

7 Claims, 4 Drawing Figures

BAG FOLDING MACHINE

The present invention relates to a machine for folding flexible plastic sheet material such as plastic bags and more particularly to an improvement in folding machines of the type which winds the bag into a roll and withdraws the rolled bag in a flattened state.

The present invention is specifically directed to folding machines of the type disclosed in U.S. Pat. No. 3,918,698, entitled "High Speed Machine And Method For Folding Plastic Bags And The Like" which issued on Nov. 11, 1975 in the name of John Coast and U.S. Pat. No. 3,671,033, entitled "Machine And Method For Folding Plastic Bags And The Like" which issued on June 20, 1972, also in the name of John Coast.

The above patents, the disclosures of which are herein incorporated by reference, each disclose the use of a rolling section which forms a curved moving surface disposed a minimum of 270° of a circle for winding the material into a roll. The rolling section is divided into at least two laterally separated sub-sections which are spaced apart to form an open unobstructed area therebetween for removing the rolled bag. Each sub-section is formed from a set of horizontally disposed parallel drive rollers whose axes are disposed a minimum of 270° of a circle to present on their inward side and within each sub-section a moving surface throughout at least a substantial portion of the 270 degrees of a circle for driving the material into a roll. The rollers are arranged to form, in effect, a cul-de-sac having an entrance opening adapted for receiving the material. After the bag is rolled it is removed through the open area between the laterally spaced sub-sections.

It has been found that the removal of the bag through the opening between the sub-sections must be carefully controlled to avoid wrinkling or creasing of the plastic sheet material. This is due to the fact that the rolled bag is processed into a flat geometry from a tubular geometry in conjunction with its removal from the rolling section. During the removal operation the bag is susceptible to wrinkling, particularly at high folding speeds. High folding speeds are, however, desirable from a production standpoint.

In accordance with the present invention it has been found that high speed folding can be achieved by providing an enlarged area for the withdrawal of each bag and by withdrawing each bag from the rolling section over a flat surface in a direction substantially transverse to the direction of entry. Such high speed withdrawal of the bag is facilitated by drawing the bag over a planar surface coextensive with the entrance opening and preferably having a leveled geometry formed at the end of each sub-section adjacent the opposite sides of the open area between the sub-sections. The preferred arrangement is to support the drive rollers in each sub-section between end plates with the corresponding end plates on opposite sides of the open area having an aperture of predetermined configuration for providing the enlarged area for withdrawal of the rolled bag.

Accordingly, it is the principal object of the present invention to provide an improved folding machine for folding bags by rolling each bag into a roll and withdrawing each rolled bag in a flattened state at a relatively high speed of from 100–200 bags a minute depending upon bag size without introducing objectionable wrinkles.

Other objects and advantages of the present invention will become apparent from the following detailed description of the invention when read in conjunction with the accompanying drawings of which:

Referring now to FIGS. 1–4 inclusive illustrating the improved folding machine of the present invention in which plastic bags are individually wound into a roll of tubular geometry and flat folded. It should be understood that the bags are formed from any suitable polymeric material using any conventional bag making operation. The preferred bag is the "U" folded side seam welded bag having a seamless bottom. Although the folding machine of the present invention is intended primarily for folding bags it is equally applicable for folding sheet goods of similar polymeric material.

Figures 1, 4:
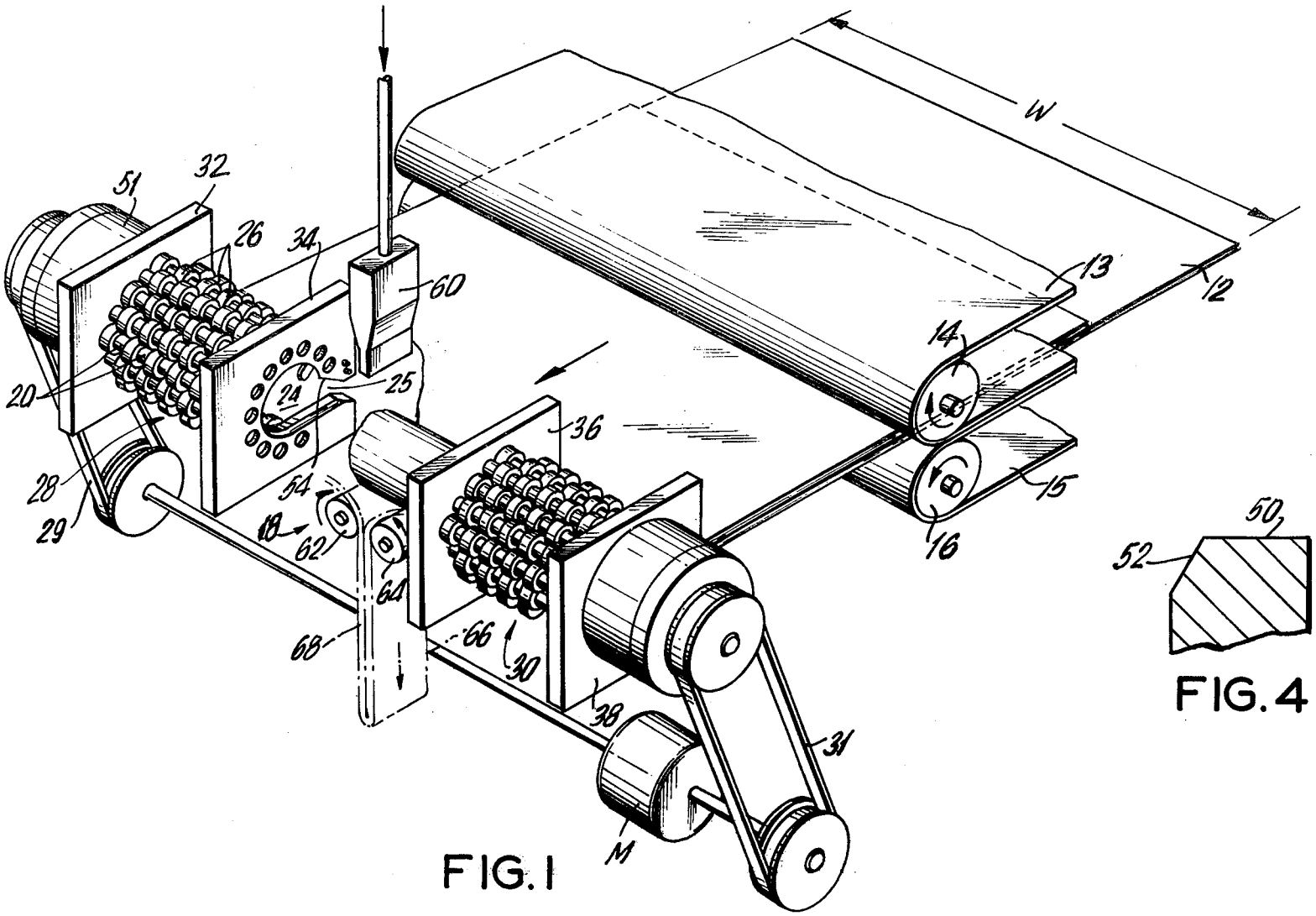
FIG. 1 is a perspective view of the folding machine of the present invention.
FIG. 4 is an enlarged fragmentary section taken along the lines 4—4 of FIG. 3.

As schematically illustrated in FIG. 1, a bag 12 is fed, at a predetermined speed, from a pair of endless belts 13 and 15 driven by rollers 14 and 16, into the rolling section 18 of the folding machine. Although the endless belts 13 and 15 have been shown in FIG. 1 spaced a relatively substantial distance from the rolling section 18, it is preferred that they be positioned as close as possible to the entrance of the rolling section. The bag 12 may have already been prefolded any number of times to establish a predetermined width W preferably as taught in U.S. application Ser. No. 829,926, now U.S. Pat. No. 4,151,787, "A Multiple Folded Plastic Bag and Method" filed on Sept. 1, 1977, and now U.S. Pat. No. 4,151,787.

Figure 3:
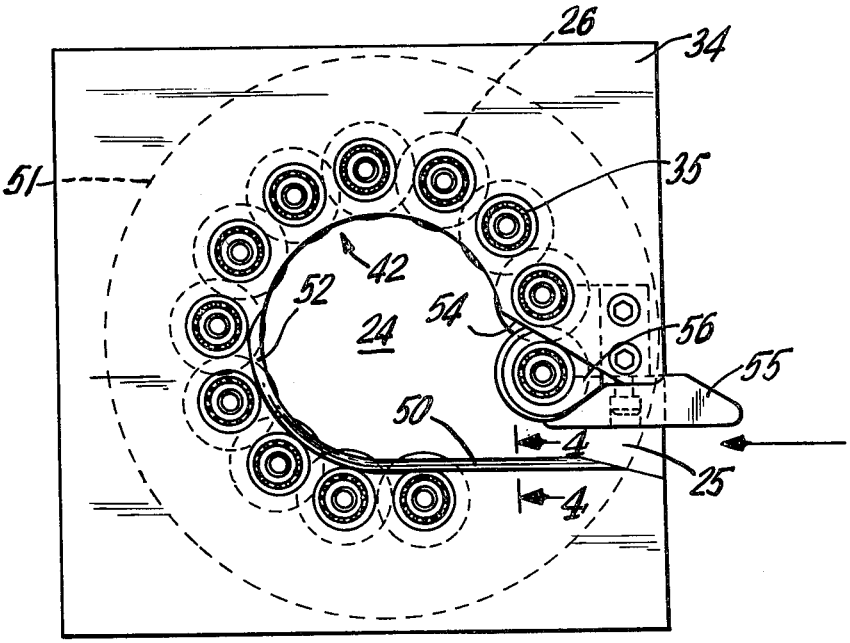
FIG. 3 is a end view of the sub-section of FIG. 2.

The rolling section 18 includes a series of drive rollers 20 having alternating protrusions 26 which interact with the bag to cause the bag, by a positive drive action, to be wound into a roll. The longitudinal axes of the rollers 20 are disposed at least 270° of a circle to form a cul-de-sac having a partial enclosure 24 of generally cylindrical configuration with a periphery defining the inside moving surface of the protrusions 26 for driving the bag 12 around into a roll. The cul-de-sac partial enclosure 24 leaves an opening 25, as best shown in FIG. 3, representing the entrance opening to the bag rolling section 18. Driving force is transmitted to the bag by friction between the elastomeric protrusions 26 of the drive rollers 20 and the bag itself.

Centrifugal force, bag material stiffness and the diameter of the bag as it is being rolled contribute to the normal force which holds the bag against the inner surface of the drive rollers 20 and positively guide it to its rolled condition. Although not shown, it is within the scope of the present invention to use a rotatable spindle disposed within the cul-de-sac to assist in the rolling operation as taught in the corresponding application U.S. Ser. No. 920,051 filed of even date herewith; the disclosure of which is incorporated herein by reference.

Figure 2:
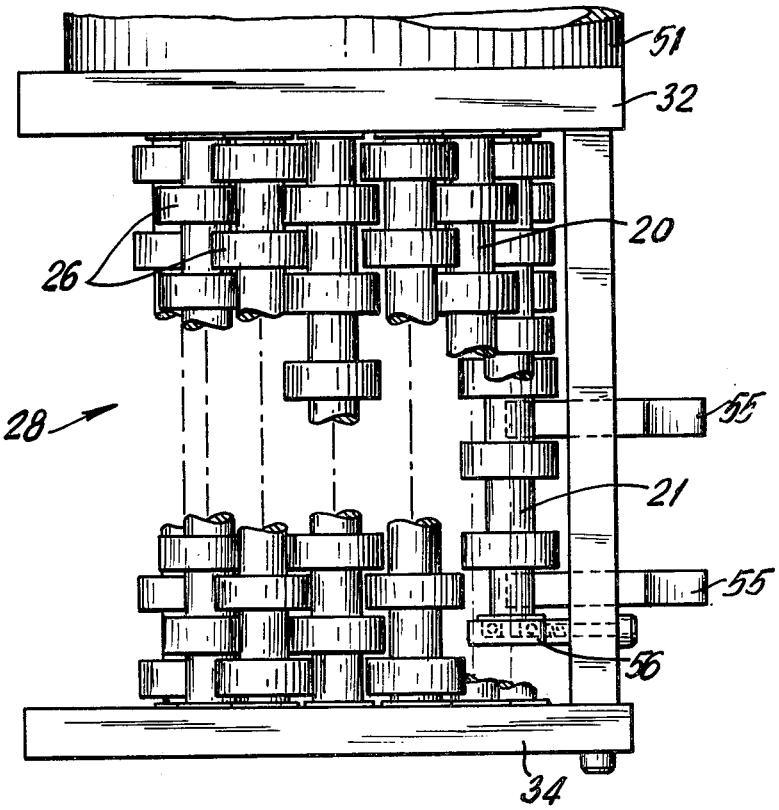
FIG. 2 is a top view of one of the rolling sub-sections of FIG. 1.

To prevent the bag from escaping between the rollers 20, the protrusions 26 on each drive roller 20 interdigitate with protrusions 26 on adjacent drive rollers 20, as is best shown in FIGS. 1 and 2. The rollers 20 are fabricated by vulcanizing an elastomeric material to a shaft and subsequently grooving the elastomeric material to form the protrusions 26. The grooves between protrusions 26 have a width at least about ⅛" greater than the width of the protrusions 26 of adjacent rollers and a depth that will provide clearance for the protrusions of adjacent rollers. The degree of interdigitation of intermeshing can be controlled by varying the protrusion width, diameter, or spacing and thereby the amount of overlap or intermesh. Friction characteristics of the system can of course also be varied by changing the elastomeric materials.

In order to permit the removal and flat folding of the rolled bag in the manner as hereafter explained, the rolling section 18 is centrally gapped, that is, it is divided into two preferably equal and separate sub-sections 28 and 30 respectively. The area 32 between the sub-sections 28 and 30 is thus basically an unobstructed open area. Although the sub-sections 28 and 30 are spaced from each other to establish the open area 32, they are intended to be driven from a single motor M which interconnects the drive rollers 20 of each sub-section 28 and 30 for common rotation through belts 29 and 31 and gearing assembly 51, 51. The arrangement of drive rollers 20 within each sub-section 28 and 30 is identical thereby forming an equivalent cul-de-sac geometry within each sub-section.

The drive rollers 20 are rotatably supported in bearings 35 in each sub-section 28 and 30 between a pair of structural end plates 33, 34 and 36, 38 respectively, with the drive rollers 20 of sub-section 28 disposed in parallel alignment with the corresponding drive rollers 20 in subsection 30. The end plates 34 and 36 lie parallel to one another on opposite sides of the open area 32 with each having a corresponding aperture 42, 42 in alignment with and partially conforming to the shape of cul-de-sac partial enclosure 24. The geometry of the aperture 42 of each sub-section 28 and 30 has been found to play a significant role in achieving high speed removal of the rolled bag 12 without objectionable wrinkles.

For removal of a rolled bag it is preferred to withdraw the bag from the open area 32 in a direction substantially transverse to the direction of entry and to provide as much clearance as possible for conversion from a tubular to flat geometry.

To achieve this, the apertures 42 in end plates 34 and 36 are designed to have a contoured geometry including a substantially flat level bottom 50 lying substantially tangent to the moving surface of the cul-de-sac, a curved portion 52 generally conforming to the outline of the moving surface of the cul-de-sac partial enclosure 24 and terminating in an upper surface 54 lying at an angle inclined with respect to the bottom surface 50 so as to provide as much room as possible for the rolled bag 12 to transform its circular shape during extraction to an oval with the major axis parallel to the flat surface 50, thus minimizing wrinkling in the folded finished product. The inclined surface 54 necessitates reducing the length of one of the drive rollers 20 in each sub-section and identified as 21 in FIG. 2. The shortened drive roller 21, which is preferably shortened by eliminating one protruding portion 26, lies between the inclined surface 54 and the flat bottom surface 50. A separate mounting lug 56 is used to provide a support for rotatably supporting the shortened drive roller 21. The shortened drive roller 21 in combination with the removal of end plate material results in an inclined surface 54 which allows the circular bag to attain an oval shape when a vertical force is applied normal to the flat surface 50 of the rolled bag.

The flat bottom surface 50 of each aperture 42, 42 should have a shaped end 52 at the juncture with the open area which is preferably beveled. The beveled end 52 facilitates removal of the rolled bag from the open area 32. The bottom surface 50 provides a flat surface area over which the bag is drawn during withdrawal and also serves as an extension of the entrance opening 25 for guiding the bag 12 into the sub-sections 28 and 30 respectively. Additional guide members 55, 55 associated with each sub-section 28 and 30 guide the incoming bag into the rolling section 18.

The rolled bag 12 is withdrawn from the rolling section 18 by applying a force to the bag 12 in a preferred discharge direction with the open area 32 lying transverse to the direction in which the bag originally entered. The force is mechanically applied to the center of the bag 12 preferably by a reciprocating tucker blade 60 which extends across the width of the rolling section. This causes the bag 12 to fold over while being driven between the nip rollers 62 and 64. The nip rollers flatten the bag and establish well defined folded edges 66 and 68. Thereafter, the folded bag may be refolded any number of additional times, if so desired, and packaged.

What is claimed is:

1. In a machine for producing folded flexible sheet material, such as plastic bags, having rolling means for rolling the material into a roll and means for removing the rolled material from said rolling means in a flattened condition, wherein said rolling means comprises; a rolling section arranged in an arc circumscribing a minimum of 270° of a circle for forming a cul-de-sac having a moving curved surface through at least a substantial portion of said 270°, with said rolling section being divided into at least two laterally disposed sub-sections spaced apart so as to provide a predetermined unobstructed open area therebetween, with each sub-section having an entrance opening for receiving said material; and means for driving each sub-section at a common speed sufficient to cause said material to wind about said moving curved surface into said roll, the improvement which comprises: said means for removing the rolled material being arranged relative to said open area to establish a discharge path through said open area in a predetermined direction normal to the longitudinal axis of said rolled material; with each entrance opening having a first flat surface located on opposite sides of said open area in a common plane lying transverse to and substantially normal to said predetermined discharge path and a second surface spaced a predetermined distance apart from said first surface to provide a substantial clearance for conversion of the rolled material from a tubular to an oval shape during withdrawal with said first surface being disposed relative to said removal means such that said rolled material upon withdrawal is drawn over said first flat surface.

2. In a machine as defined in claim 1 wherein each entrance opening has a beveled surface located adjacent said first flat surface and said open area.

3. In a machine as defined in claims 1 or 2 wherein each sub-section is formed from a series of drive rollers extending from a pair of end support plates with the axes of said rollers disposed in an arrangement forming said cul-de-sac and providing an opening representing said entrance opening with the drive rollers of one sub-section being in parallel alignment with the corresponding drive rollers of the other sub-section and wherein the end support plates on opposite sides of said open area each have an aperture in alignment with said cul-de-sac and a predetermined geometry partially conforming to the shape of said cul-de-sac.

4. In a machine as defined in claim 3 wherein the predetermined geometry of each aperture includes a lower planar surface coextensive with said first flat surface and a curved surface extending from said first surface and conforming to the shape of said cul-de-sac.

5. In a machine as defined in claim 4 wherein each aperture further comprises a fourth substantially flat surface extending from said curved surface at an inclined angle relative to said lower planar surface.

6. In a machine as defined in claim 5 wherein the width of at least one of said rollers in each sub-section as measured along their longitudinal axes is shorter than the width of the other rollers and lies between said fourth surface and said first surface.

7. In a machine as defined in claim 4 wherein said means for removing the rolled material from said open area comprises a reciprocating tucker blade aligned along said discharge path for linear movement substantially between said end support plates normal to the common plane including said first flat surface of each sub-section.

* * * * *